US005397035A

United States Patent [19]

Law

[11] Patent Number: 5,397,035

[45] Date of Patent: Mar. 14, 1995

[54] DISPENSER PUMPS

[75] Inventor: Brian R. Law, Leicester, England

[73] Assignee: The English Glass Company Limited, United Kingdom

[21] Appl. No.: 127,579

[22] Filed: Sep. 28, 1993

[30] Foreign Application Priority Data

Sep. 28, 1992 [GB] United Kingdom ..... 9220424

[51] Int. Cl.[6] ..... B67D 5/40

[52] U.S. Cl. ..... 222/383

[58] Field of Search ..... 222/383, 207

[56] References Cited

U.S. PATENT DOCUMENTS

| | | | |
|---|---|---|---|
| 3,680,986 | 8/1972 | Kutik et al. . | |
| 3,752,366 | 8/1973 | Lawrence | 222/207 |
| 4,218,178 | 8/1980 | Kutik et al. | 417/566 |
| 4,489,861 | 12/1984 | Saito et al. | 417/566 X |

FOREIGN PATENT DOCUMENTS 0154545 9/1985 European Pat. Off. .

OTHER PUBLICATIONS (Drawing of dispenser pump sold in the U.S. in Feb. 1990) Englass FN30 Dispenser, "englass"; The English Glass Company Limited, Scudamore Road, Leicester LE3 1UG.

*Primary Examiner*—Richard E. Gluck
*Attorney, Agent, or Firm*—Lason and Taylor

[57] ABSTRACT

A dispenser pump has a base incorporating an intake tube, an axially-upright cylindrical pump body fixed on top of the base by a screw-threaded engagement, and a cap plunger having a piston which sweeps the interior of the body. A discharge spout opens from a discharge opening adjacent the base. Both the outlet and inlet openings are valved by a one-piece valve body in the form of a free-standing sleeve resting on the base, with a peripheral lip forming the outlet valve at one end of the sleeve and a radially-inward projection forming the inlet valve as a flexible flap. The body and base are separable to release the valve body for easy cleaning.

24 Claims, 1 Drawing Sheet

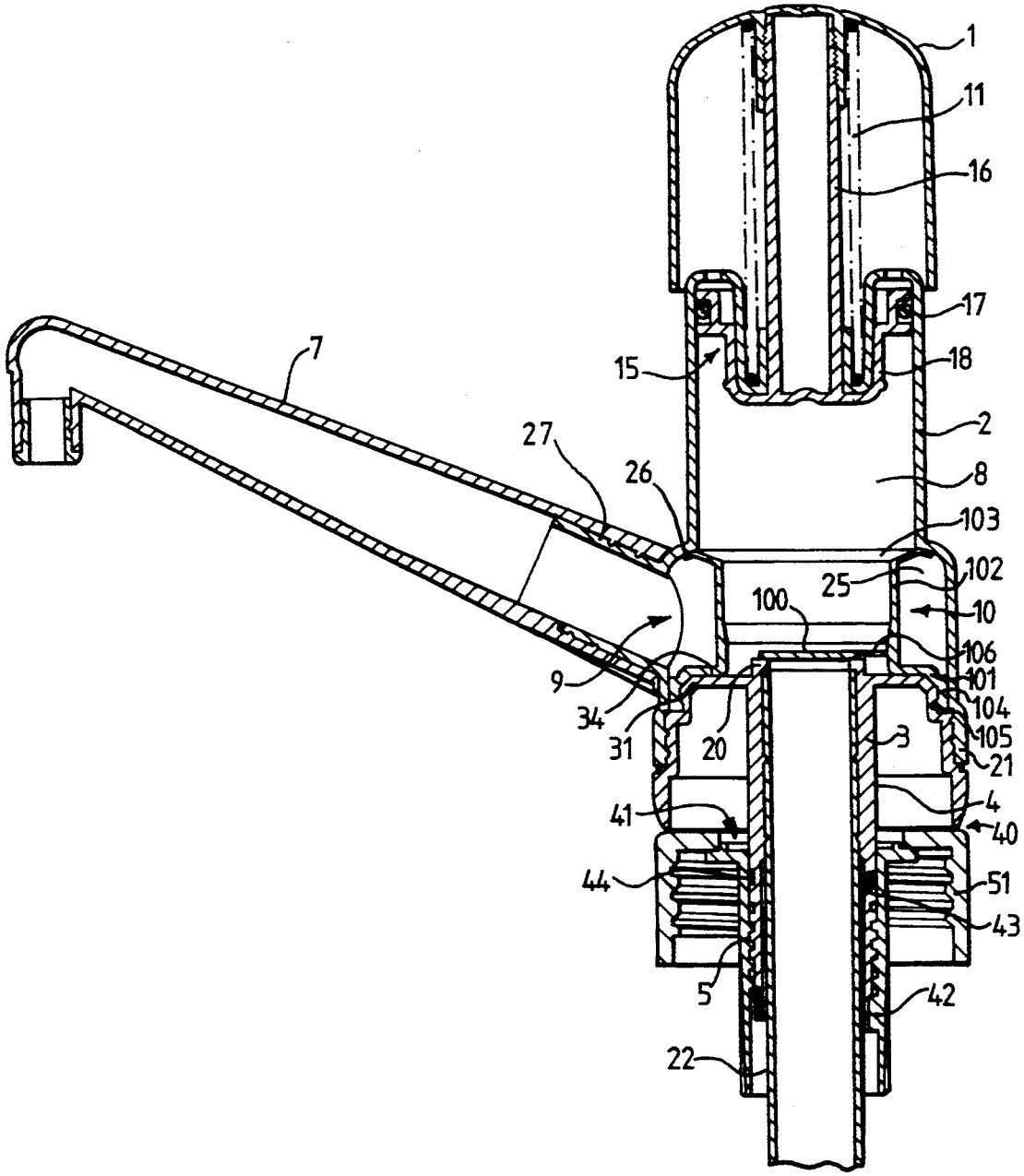
1
11
16
17
18
15
2
8
7
27
26
103
102
25
100
10
106
101
104
105
21
9
34
31
20
3
4
40
41
44
51
43
5
42
22

DISPENSER PUMPS

FIELD OF THE INVENTION

This invention concerns dispenser pumps, more particularly pumps in which pumpable material is drawn from a supply into a pump chamber through a valved inlet and discharged from the pump chamber through a valved outlet, by the action of a reciprocable plunger—usually hand-operated—which alters the volume of the pump chamber. The reciprocable plunger may have a piston to sweep out a cylinder, or may constitute a cylinder to be swept by a fixed piston, or it may deform a deformable wall of the pump chamber such as a foldable or elastomeric diaphragm.

BACKGROUND OF THE INVENTION

In one known type of pump, the inlet enters the pump chamber through a base thereof, and the outlet is also from the lower part of the pump chamber to provide clearance for the sweeping of the piston of an upwardly spring-biased cap plunger, with an outward seal against the pump chamber wall.

Valving of the inlet and outlet conventionally involves at least one ball valve. These are well-proven but require complicated assembly of a large number of parts, and are difficult to disassemble and clean thoroughly. The difficulty in cleaning is particularly troublesome when there is a need for hygienic pumping e.g. of food materials such as sauces.

U.S. Pat. No. 3,680,986 (Kutik & Gronemeyer) describes a pump which uses a one-piece valve in the form of a sleeve having a peripheral lip which forms an outlet valve and a central, flexibly-attached piece which forms an inlet valve. Both valves flex at the same level, however, and the sleeve serves no function other than for positive location and positioning of the valve body in deep recesses of the pump body. These will be very difficult to clean.

SUMMARY OF THE INVENTION

An object of the developments described herein is the development of a new valving arrangement for a plunger pump which is consistent with simple assembly, disassembly and cleaning.

Aspects are set out in the claims.

In one aspect, we form the outlet valve on a one-piece valve body, preferably moulded from plastics material, which has an upper lip or flap—relatively flexible in construction—contacting the inner wall of the pump chamber to form an outlet valve between the pump chamber and the outlet, and a dividing wall—relatively inflexible in construction—extending axially down the pump from the outlet valve towards the pump chamber base, having an outer surface which bounds an outlet space downstream of the outlet valve, and an inner surface which bounds an inlet space downstream of the inlet at the entrance to the pump chamber, so as to separate the inlet space and outlet space from one another.

Preferably the foot of the dividing wall contacts against the floor of the pump chamber. It is also preferred that a movable valve element of the inlet valve, e.g. a radial flap, be formed as an integral part of this valve body; conveniently this extends out transversely (in the closed condition) relative to the axially-extending dividing wall.

In another aspect, the pump valve body comprises a sleeve which is positioned in the pump contacting the base of the pump chamber around the inlet with its lower part and contacting around the pump chamber wall with its upper part, the upper part having a lip or flap which constitutes an outlet valve between the pump chamber and an outlet space downstream thereof, and the axially-extending wall of the sleeve isolating a space above the inlet from the outlet space.

Preferably the sleeve is a one-piece body, e.g. moulded from plastics material. Most preferably it also comprises integrally a movable element—a flap or lip—of the inlet valve. The inlet valve element preferably projects into the sleeve interior at or near its foot, so as to co-operate with an inlet opening at or near the base of the pump chamber.

Most preferably, the movable element of the outlet valve extends around the upper edge of the sleeve, and the outlet space may correspondingly extend around the wall formed by the sleeve.

The outlet valve preferably operates against a downwardly-facing surface of the pump chamber wall. It is desirably urged against that surface in the closed condition by its own resilient deformation.

The inlet space inside the valve body is desirably unobstructed so as to allow that space to be swept by a piston part of the pump plunger. For this, it is preferred that the inlet opening and valve be at or adjacent the bottom of the valve body, rather than projecting up into it.

In other aspects, it is preferable that the pump can be dismantled by separating a base part having the inlet from a pump body part having the plunger, so that the valve body can then be removed, e.g. for cleaning. Preferably the base part has a screw-threaded engagement with the body part. It is also preferred that the valve body has a part which is trapped between the assembled body part and base part, to hold it in position. This may be e.g. a skirt or flange at the foot of the valve body.

The pump outlet may have a radially-extending spout projecting from the pump body. For ease of cleaning, this may be detachable from the body.

The plunger and inlet are preferably aligned along an axis of the pump, and where the valve body is a sleeve this is also preferably aligned with that axis.

The base part of the pump is usually adapted to fix removably to a container of pumpable material. This may be by e.g. a cap element through which the inlet passage extends. Venting of the pump may be, as conventional, through clearances extending down around the wall of the inlet passage.

In an independent aspect, we find that a useful venting/non-venting feature for a pump of this general type can be provided by providing a location for a removable seal e.g. a sealing ring, to be positioned to close off a venting clearance around the inlet passage wall. This is useful when the pump is used on a flexible material supply container which is intended to collapse as its contents are consumed.

BRIEF DESCRIPTION OF THE DRAWINGS

In the drawings, the single FIGURE shows, in axial cross-section, the preferred form of pump embodying the invention.

DETAILED DESCRIPTION OF THE PREFERRED EMBODIMENTS

The pump shown is an axially-upright, hand-operated pump made essentially from plastics material. This embodiment is intended for pumping food products such as sauces, and the dose size is typically 10 to 100 ml e.g. 30 ml.

The basic pump elements are a closure cap 51 for fixing to a container neck, a pump base or core 3 incorporating an intake tube 4 which extends down through the cap 51 and clamps it axially, an axially-upright cylindrical pump body 2 fixed on top of the base 3, a cap plunger 1 on top of the body 2, and a discharge spout 7 projecting radially from the pump body near the junction with the base 3.

A free-standing valve body 10 is seated in the bottom of the pump chamber 8 formed by the body 2, in axial register with the outlet opening 9 which leads to the spout 7.

Typically the cap plunger 1, body 2, core 3 and spout 7 might be of polypropylene.

The cap plunger 1 is connected, by a central axial stem 16, to a piston 15 which operates in the pump chamber 8 and is biased upwardly by a return spring 11. An outwardly directed seal 17 of the piston wipes the inner cylindrical wall of the pump body. A nitrile rubber "O" ring seated in a groove gives a suitable seal. The piston 15 has a central nose 18 projecting axially below the seal 17.

The top of the base element 3 forms a generally flat floor 34 at the bottom of the pump chamber 8, through which the inlet tube 4 opens centrally at an inlet opening, essentially flush but with a slight annular peripheral projection 20 on which an inlet valve flap 100 (described later) seats.

The valve body 10 sits on top of the base 3. It is of more flexible material than the pump body components e.g. low density polyethylene. Its primary elements are a support and location portion 101 which sits on top of the base 3, a sleeve wall 102, cylindrical in this embodiment, which extends axially above the base up to slightly above the top of the outlet opening 9, a valve lip 103 around the top edge of the sleeve wall 102 and which engages the inner surface of the pump body 2 above the outlet 9, and the inlet valve element 100 (already mentioned) which projects radially in to the center of the sleeve 102 from its wall near its foot.

In more detail, the support portion 101 comprises a radial outward flange from the foot of the wall 102, with a peripheral skirt 104 which fits around a top boss 31 of the base 3 and has an in-turned lip 105 engaging under the boss 31 so that the valve body 10 is retained axially on the base 3. The downward skirt 104 is also trapped radially between the boss 31 and the plain bore just above a threaded skirt 31 at the bottom of the wall of the pump body 2 so that, in the assembled pump, the valve body cannot escape.

The sleeve portion 102 has a slightly thickened lower part for stability, and the circular inlet valve flap 100 is connected to this thickened portion by a flexible neck 106.

In axial register with the sleeve 102, the pump body 2 has a slight radial enlargement corresponding to an annular outlet chamber 25 extending around the outside of the sleeve wall 102. The outwardly-flaring valve lip 103 of the valve body, made relatively thin for flexibility, is urged against a downwardly-facing shoulder 26 at the top of this radially-enlarged portion. The lip 103 thereby separates the outlet chamber 25 from the main pump chamber 8, but in operation can flex away from its engagement with the shoulder 26 to allow pressurised material to escape from the pump chamber 8 into the annular outlet chamber 25 and to the outlet 9.

The cylindrical space defined by the inside of the sleeve 102 is unobstructed, and is substantially—i.e. most of its volume—swept out by the nose 18 of the plunger 15 on the downstroke.

The long upwardly-angled discharge spout 7 is snap-fitted onto a projecting spigot 27 on the pump body at the outlet 9, so that it can easily be pulled off.

The pump can easily be dismantled by unscrewing the base 3 from the body 2. The base 3 and attached valve body 10 can then be withdrawn from the body, untrapping the flexible skirt 104 of the valve body so that this can then easily be pulled off the boss 31 of the base 3. With the spout 7 pulled off the body 2, the pump has been reduced to a number of basic parts which are all of relatively open construction and are easy to clean. This is a considerable practical advantage when the pump is being used with food products.

In normal applications with rigid containers, the container needs to be vented to compensate for dispensed material. In this embodiment, this is provided for by a small clearance 40 between an outer skirt 32 of the base 3 and the top of the internally-threaded closure cap 51, through a central hole 41 of the closure cap 51 and down through small clearances between the threads 5 which clamp the cap 51 to the base 3 (by a nut 42 encircling the lower part of the intake tube 4). So that the pump can also be used for collapsible containers, e.g. "bag-in-box" containers, the interface between the intake tube 4 and the nut 42 is provided with a housing groove 43 which can be fitted with a seal ring e.g. a nitrile rubber "O" ring 44, to prevent venting.

A flexible dip tube 22 of conventional type is pushed into the intake tube 4 from below.

It should be understood that the words "top", "bottom" and the like are used herein for clarity of description and should not be taken as limiting on the invention as regards the orientation of the pump in use, although the illustrated specific embodiment is conventially used upright. They can be taken broadly as referring to opposite, first and second ends of the pump.

We claim:

1. A dispenser pump comprising at a first end of the pump, a pump base having an inlet opening;

an inlet valve comprising a movable inlet valve flap at the inlet opening;

a pump body releasably fixed to the pump base, the pump body having a surrounding wall extending from the pump base to define a pump chamber having an outlet opening adjacent the pump base, and the surrounding wall having a shoulder directed towards the pump base;

a plunger at a second end of the dispenser pump, the plunger being fitted to the pump body in piston-cylinder relation thereto and being reciprocable relative thereto to alter the volume of the pump chamber in a pumping action of the dispenser pump;

a return spring outside the pump chamber for biasing the plunger towards the second end of the pump, and a valve body in the pump body, the valve body being a one-piece molding of plastic and comprising a locating foot supported on the pump base;

a flexible lip contactable against an interior contact surface on said shoulder of the surrounding wall of the pump body to form an outlet valve between the pump chamber and the outlet opening, and a relatively inflexible dividing wall extending from the locating foot away from the pump base to the flexible lip, the dividing wall having an outwardly-facing surface and an inwardly-facing surface, the outwardly-facing surface bounding the interior of an outlet chamber defined in the pump body downstream of the outlet valve formed by the flexible lip, and the inwardly-facing surface bounding an inlet space defined in the pump body downstream of the inlet opening and inlet valve.

2. A dispenser pump as claimed in claim 1 in which the dividing wall of the valve body is in the form of a sleeve extending from the pump base, around the inlet opening.

3. A dispenser pump as claimed in claim 2 in which the flexible lip extends around that end of the sleeve remote from the pump base.

4. A dispenser pump as claimed in claim 3 in which the outlet chamber is annular.

5. A dispenser pump as claimed in claim 1 having a dose size of from 10 to 100 ml.

6. A pump dispenser pump as claimed in claim 1 in which the pump base has a generally flat surface forming a floor of the pump chamber.

7. A dispenser pump as claimed in claim 1 in which the pump base and pump body trap the locating foot of the valve body between them.

8. A dispenser pump as claimed in claim 1, comprising a discharge spout projecting from the outlet opening.

9. A dispenser pump as claimed in claim 1 in which the plunger comprises a piston to sweep the pump chamber.

10. A dispenser pump as claimed in claim 9 in which the piston has a central nose to sweep the inlet space separated from the outlet chamber by the dividing wall of the valve body.

11. A dispenser pump as claimed in claim 1 in which the valve body comprises an inlet valve element projecting over the inlet opening.

12. A dispenser pump as claimed in claim 11 in which the inlet valve element projects adjacent the locating foot of the valve body.

13. A dispenser pump as claimed in claim 1 in which the valve body is of low-density polyethylene.

14. A dispenser pump comprising a pump base having an inlet opening;

an inlet valve at the inlet opening;

a pump body releasably fixed to the pump base and extending therefrom to define an axial direction, the pump body enclosing a pump chamber communicating with the inlet opening, and having a radially-directed outlet opening adjacent the pump base;

plunger means mounted on the pump body and reciprocable relative thereto to alter the volume of the pump chamber in a pumping action of the dispenser pump, and a free-standing valve sleeve supported on the pump base, the valve sleeve having a locating foot to engage with and locate on the pump base, the locating foot being trapped between the pump body and pump base so as to be releasable when the pump body is released from the pump base;

a free-standing non-deforming dividing wall having the form of a sleeve extending away from the pump base past the outlet opening, and surrounding the inlet opening, and a flexible annular lip flaring outwardly at the periphery of the sleeve remote from the pump base, to contact resiliently around an inward sealing surface of the pump body;

said pump further including an outlet chamber defined between an inward surface of the pump body and an outward surface of the valve sleeve dividing wall, and being in communication with the outlet opening, whereby the flexible annular lip of the valve sleeve forms an outlet valve between the pump chamber and the outlet chamber.

15. A dispenser pump as claimed in claim 14 in which the pump body is a generally cylindrical tube.

16. A dispenser pump as claimed in claim 14 in which the pump body has a shoulder facing towards the pump base, and the inward sealing surface contacted by the flexible annular lip of the valve sleeve is on said shoulder.

17. A dispenser pump as claimed in claim 14 in which the valve sleeve further comprises an axially flexible radially-inward projection adjacent the locating foot, engaging over the inlet opening to form an inlet valve.

18. A dispenser pump as claimed in claim 17 in which the valve sleeve is a one-piece molding of plastic.

19. A dispenser pump as claimed in claim 14 having a dose size of from 10 to 100 ml.

20. A dispenser pump as claimed in claim 14 in which the pump base has a generally flat surface forming a floor of the pump chamber.

21. A dispenser pump as claimed in claim 14 in which the valve sleeve is of low-density polyethylene.

22. A dispenser pump comprising a cap element for screwing onto the neck of a container of pumpable material;

a pump base on the cap element, said pump base having an intake tube which extends down through the cap element and which has an upwardly axially-directed inlet opening;

a generally cylindrical upright pump body releasably fixed on top of the pump base to define a pump chamber, the pump body having a radially-enlarged portion adjacent the pump base, an outlet opening at the radially-enlarged portion, and a downwardly-facing shoulder at the top of the radially-enlarged portion above the outlet opening;

a plunger mounted on top of the pump body and reciprocable relative thereto, the plunger comprising a piston and the piston having an outwardly-directed seal for wiping the cylindrical inner wall of the pump body to thereby alter the volume of the pump chamber when the plunger is reciprocated in a pumping action of the dispenser pump;

a return spring biasing the plunger upwards;

a one-piece plastic valve body comprising a locating foot in the form of a flange engaging the pump base adjacent the inlet opening, and releasable from the engagement with the pump base when the pump base is released from the pump body;

a dividing wall in the form of a cylindrical sleeve extending axially up from the locating foot and away from the inlet opening of the pump base, through the radially-enlarged portion of the pump body and past the outlet opening to define an outlet chamber between the dividing wall and the radially-enlarged portion of the pump body;

a flexible lip flaring outward around the top of the cylindrical sleeve dividing wall, and contacting resiliently against the downwardly-facing shoulder of the pump body to act as an outlet valve between the pump chamber and the outlet chamber, and an axially-flexible radially-inward projection adjacent the locating foot for engaging over the inlet opening to act as an inlet valve.

23. A dispenser pump as claimed in claim 22 having a dose size of from 10 to 100 ml.

24. A dispenser pump as claimed in claim 22 in which the valve body is of low-density polyethylene.

* * * * *